US006286475B1

(12) United States Patent
Pierro

(10) Patent No.: US 6,286,475 B1
(45) Date of Patent: Sep. 11, 2001

(54) ENGINE BLOCK

(75) Inventor: Enzo Pierro, Maidenhead (GB)

(73) Assignees: Cummins Engine Company Ltd., Darlington; Iveco (UK) Ltd., Watford; New Holland U.K. Ltd., Basildon, all of (GB)

( * ) Notice: Subject to any disclaimer, the term of this patent is extended or adjusted under 35 U.S.C. 154(b) by 0 days.

(21) Appl. No.: 09/416,070

(22) Filed: Oct. 12, 1999

(30) Foreign Application Priority Data

Oct. 9, 1998 (GB) ..... 9822016

(51) Int. Cl.[7] ..... F02F 7/00
(52) U.S. Cl. ..... 123/195 A
(58) Field of Search ..... 123/195 R, 195 A, 123/198 R, 198 C, 509, 41.44, 41.47

(56) References Cited

U.S. PATENT DOCUMENTS 3,781,137 * 12/1973 Engstrom ..... 417/360
4,218,193 * 8/1980 Mehne ..... 417/364
4,257,370 * 3/1981 Kasting ..... 123/198 E
4,998,515 * 3/1991 Carvalho ..... 123/195 C
5,458,100 10/1995 Neuenfeld ..... 123/195 A

FOREIGN PATENT DOCUMENTS 2026599 2/1980 (GB) .

* cited by examiner

*Primary Examiner*—Noah P. Kamen
*Assistant Examiner*—Hai Huynh
(74) *Attorney, Agent, or Firm*—Gary M. Gron

(57) ABSTRACT

An engine block is described having at one end a lateral flange 12 formed with an aperture for mounting of an ancillary unit such as a pump 16. An adapter plate 30 is mounted on the end face of the lateral flange to overlie the aperture for the ancillary unit 16, the surface of the adapter plate facing the aperture being machined to mate, when in use, with an ancillary unit 16 disposed on the other side of the flange 12 and secured to the adapter plate 30 through the aperture in the lateral flange.

9 Claims, 3 Drawing Sheets

ENGINE BLOCK

FIELD OF THE INVENTION

The present invention relates to an engine block having at one end a lateral flange formed with an aperture for mounting of an ancillary unit, such as a pump or other accessory.

BACKGROUND OF THE INVENTION

The invention is particularly applicable to so-called structural engines, as used in agricultural tractors. Instead of being supported on mounts on a vehicle body, a structural engine, together with its transmission train, forms the unsprung mass or chassis of the vehicle. For this reason, its engine block needs to be designed to provide strength and rigidity.

The rear end of an engine block commonly has a flange that projects laterally and is used to support ancillary units, such as a fuel and a hydraulic pump to be driven by the crankshaft. The ancillary unit mates with the forward facing surface of the lateral flange and this surface must therefore be machined accurately after the engine block has been cast. In a structural engine, for additional strength, the block has laterally projecting ribs that are joined to the lateral flange on which the ancillary unit is mounted and these ribs interfere with the machining of the forward facing surface of the flange.

OBJECT OF THE INVENTION

The present invention seeks to enable an ancillary unit to be mounted on the lateral end flange of an engine without the need to machine the forward facing surface of the end flange.

SUMMARY OF THE INVENTION

According to the present invention, there is provided an engine block having at one end a lateral flange formed with an aperture for mounting of an ancillary unit such as a pump, wherein an adapter plate is mounted on the end face of the lateral flange to overlie the aperture for the ancillary unit, the surface of the adapter plate facing the aperture being machined to mate, when in use, with an ancillary unit disposed on the other side of the flange and secured to the adapter plate through the aperture in the lateral flange.

BRIEF DESCRIPTION OF THE DRAWINGS

The invention will now be described further, by way of example, with reference to the accompanying drawings, in which.

DETAILED DESCRIPTION OF THE PREFERRED EMBODIMENTS

Figure 1:
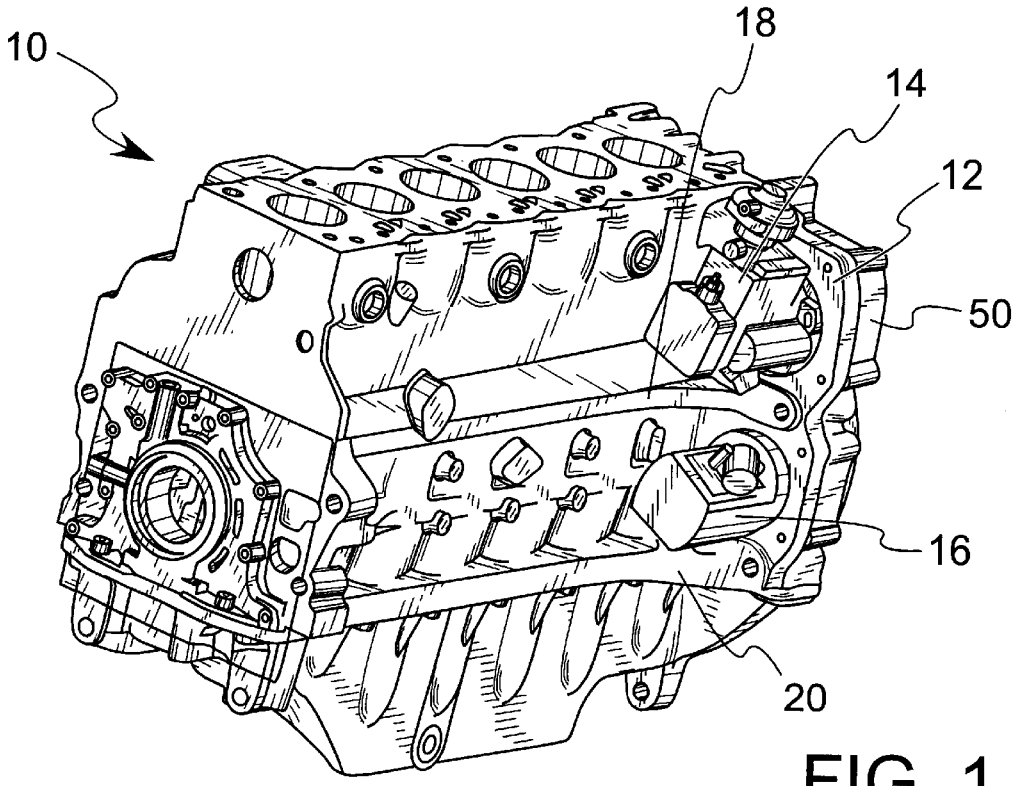
FIG. 1 is a perspective view of an engine block complete with a sump and having a projecting lateral flange on which are mounted a fuel pump and a hydraulic pump.

FIG. 1 shows an engine block 10 having a laterally projecting flange 12 at its rear end, on which are mounted a fuel pump 14 and a hydraulic pump 16. The block 10 is intended as a structural engine of a tractor and for this reason it is provided with reinforcement ribs 18 and 20 which extend up to the lateral flange 12. The ribs 18 and 20 present an obstruction to any tool used to machine the front surface of the lateral flange 12 to receive and mate with the pumps 14 and 16, the aim of the present invention being to overcome this problem.

For convenience, in the ensuing description, it will be assumed that end of the block on which the lateral flange is formed is the rear end to which the gearbox housing is connected but the invention is equally applicable to either end of the engine.

Figure 4:
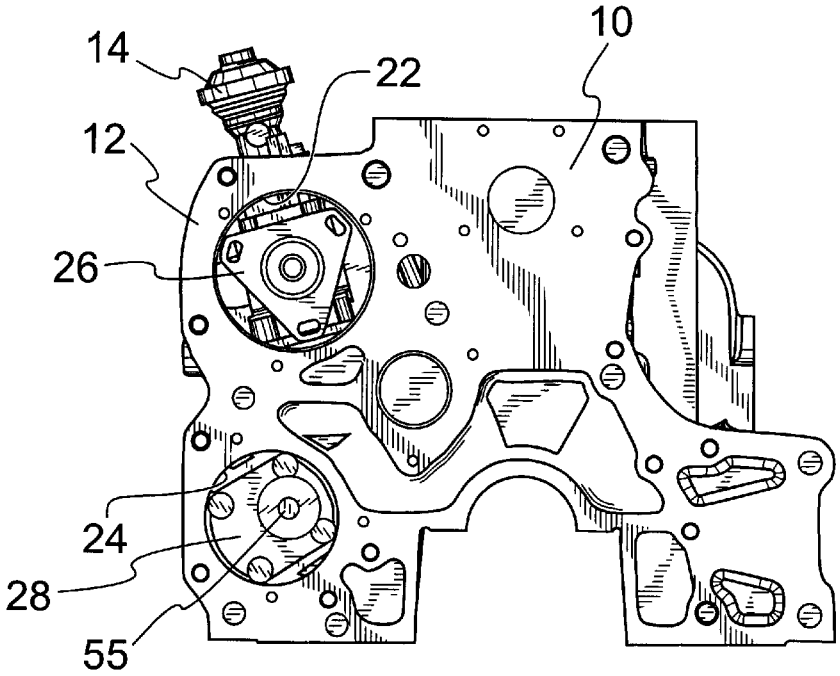
FIG. 4 is a line drawing of the engine block alone as viewed from the rear without the pump mounting adapter plates but with the pumps located in their desired mounted positions.

The lateral flange 12 is cast with apertures 22 and 24 (see FIG. 4) that are larger than the mounting plates 26 and 28 of the fuel pump 14 and the hydraulic pump 16 respectively. The mounting plates of the pumps 14 and 16 may therefore pass entirely through the apertures 22 and 24 in the lateral flange 12.

Adapter plates 30 and 32 (see FIGS. 2 and 3) are fitted over the apertures 22 and 24 respectively. Each adapter plate has a larger area than the aperture that it covers and is secured by means of bolts 34, 36 to the rear surface of the lateral flange 12 to cover the entire aperture. As the adapter plates are bolted onto the rear surface of the flange 12, it is only that surface that needs to be machined to seal against the adapter plates thereby totally avoiding the need to machine the front surface and the reinforcement ribs 18 and 20.

Figure 6:
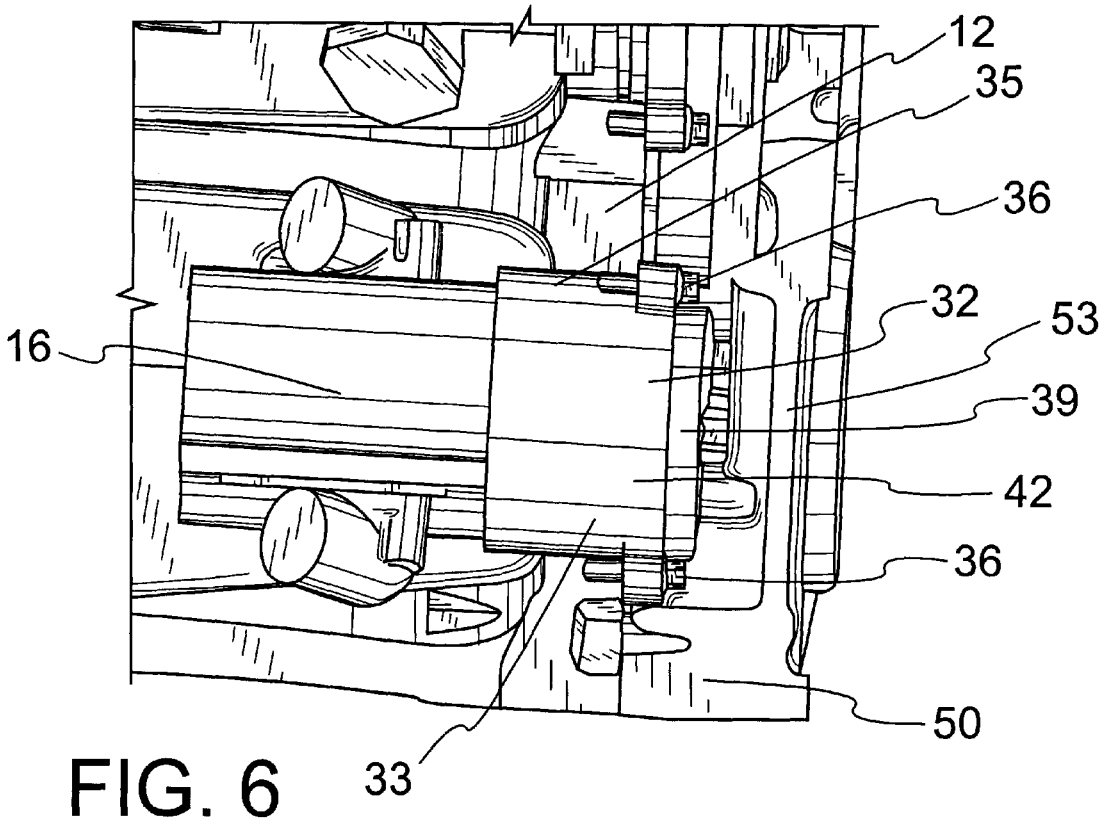
FIG. 6 is a partially cut away side view similar to that of FIG. 5 showing the manner in which the hydraulic pump is mounted in its adapter plate.

The side of the adapter plate mating with the lateral flange 12 need not be completely flat but may have a protrusion 33 extending into the apertures 22 or 24, as best seen in FIG. 6 with respect to aperture 24, for a purpose to be described furtheron.

There are many parts of the rear surface of the engine block that need to be machined after the block has been cast and the machining of the surfaces that mate with the adapter plates 30 and 32 can therefore be carried out with little incremental cost. The forward facing surfaces of the adapter plates 13 and 32 that mate with the pumps 14 and 16 (be it a surface in line with the rearward facing surface of the flange 12 or the forward facing surface of the protrusion 33) are of course machined before the adapter plates are bolted to the engine and their manufacture presents no problems. It is further possible to machine recesses into the adapter plates to receive sealing rings for establishing good seals with the rearward facing surface of the lateral flange 12 of the engine and with the mounting plate of the ancillary unit. A further seal 35 can be provided in between the radial outer surface of the protrusion 33 and the radial inner surface of the aperture 24.

Figure 2:
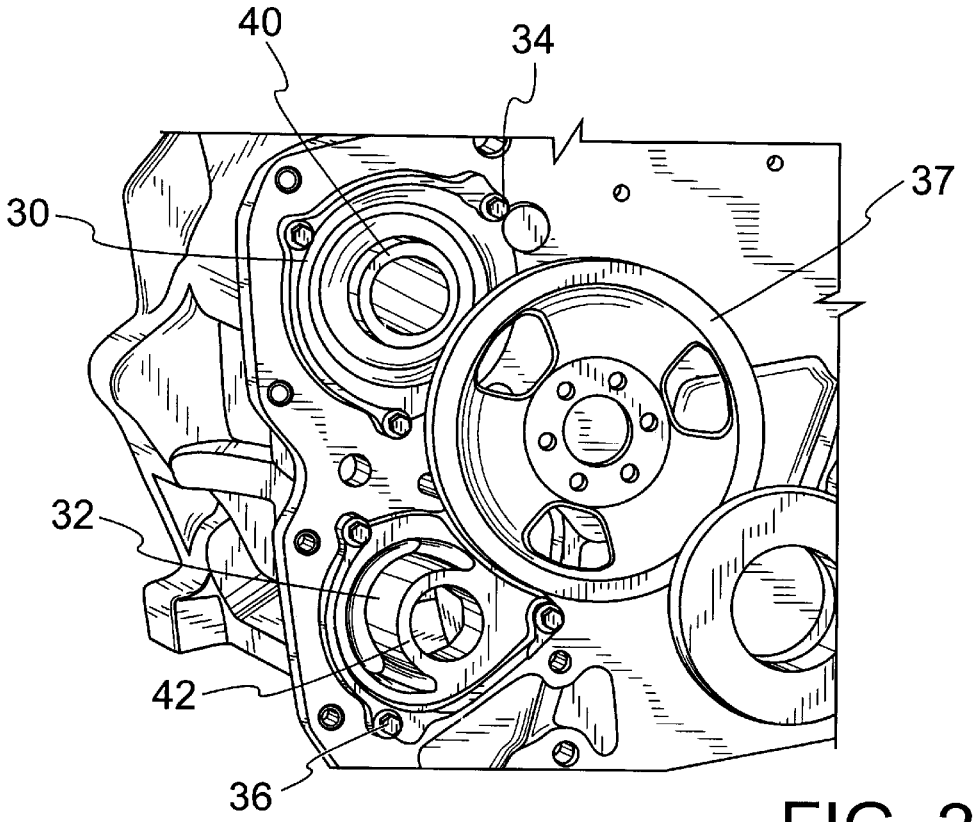
FIG. 2 is a view of the rear end of the engine block alone fitted with adapter plates for mounting of the fuel pump and the hydraulic pump.
Figure 3:
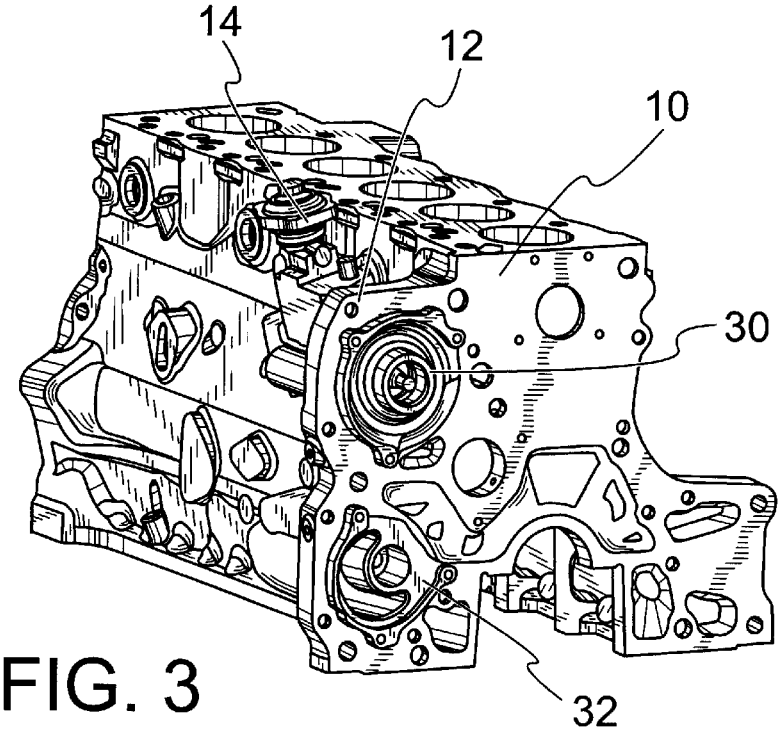
FIG. 3 is a line drawing of the engine block alone as viewed from the rear and one side after the fuel pump has been mounted on the lateral flange by means of its adapter plate.
Figure 5:
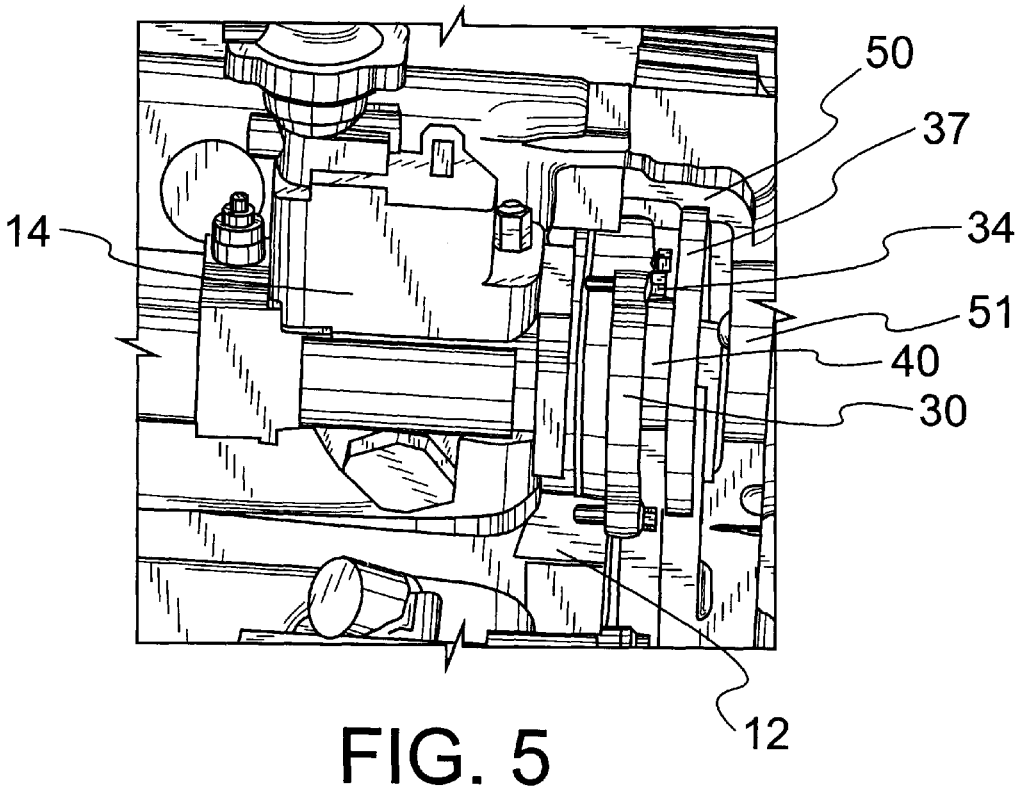
FIG. 5 is side view of the engine with part of the lateral flange and the gearbox housing cut away to reveal the manner in which the fuel pump is mounted in its adapter plate.

In addition to providing surfaces onto which the pumps 14 and 16 can be mounted and sealed, the adapter plates 30 and 32 are formed with projections 40 and 42 that can hold oil fed bushes or anti-friction bearings for supporting the shafts of the pumps 14 and 16. As shown in FIGS. 2,5 and 6,gears 37, 39 are fitted to these shafts that mesh with further gears driven by the engine crankshaft to transmit drive from the engine to the ancillary units. As seen in FIG. 6, to avoid having a projection 42 extending extensively beyond the rear surface of the flange 12 enlarging the volume of the engine, the projection 42 may also partly extend in a forward direction whereby the protrusion 33 serves as part of the projection 42.

When the engine is assembled to the transmission train, the flange 12 mates with housing 50 at the front end of the gearbox. This housing 50 may have apertures 51, 53 to allow the drive gears to be fitted to the shafts of the pumps 14 and 16 after the pumps have been mounted on the engine.

Alternatively, with reference to FIG. 5, it will be seen that the projection 40 of the adapter plate 30 acts to sandwich the drive gear 37 of the pump 14 between itself and the housing 50. Consequently, the drive gear 37 of the pump 16 can remain captive and in mesh with the other gears of its drive train, even if the hydraulic pump 14 is withdrawn for servicing.

As the drive gear may, for example, form part of the gear train driving the engine camshaft, the fact that it remains captive and in mesh with the other gears means that the engine timing need not be affected by the removal for servicing of the hydraulic pump.

It is possible in different variants of the same engine to use pumps that need to be driven at different speeds from one another. This is achieved by mounting the pumps on different centers and using gears with different ratios to drive the pumps from the crankshaft. Thus it will be seen in the case of the hydraulic pump 16 in FIG. 4 that its shaft axis 55 does not lie at the center of the aperture 24 and its shaft axis 55 has been moved inwards radically. Conventionally, this would require a modification to the manner in which the engine block is machined and possibly even to the casting of the block.

By contrast, in the present invention it is possible to make no alteration whatever to the engine block and merely to fit an alternative form of adapter plate in which the centre of the drive shaft is offset from the centre of the mounting aperture, as in the case of the adapter plate 32 for the hydraulic pump.

The precise positioning of the adapter plates 30, 32 on the rear surface of the engine lateral flange 12 is important as it determines the position of the axis of the drive shaft of the ancillary unit. In order to ensure that the adapter plates are not mounted with an incorrect orientation, it is possible to position the bolts 34 and 36 asymmetrically so that the adapter plates 30, 32 can only be fitted in a single orientation. If an adapter plate needs to be positioned with an accuracy exceeding the free play between the bolts and the holes in the adapter plate through which they pass, then it is possible to provide one or more dowels on the adapter plate to locate in holes that are drilled with the desired precision in the rear surface of the lateral flange of the engine.

While it is possible to form threaded holes in the adapter plates for receiving bolts passing through holes in the mounting plates of the pumps 14 and 16, it is preferred to provide projecting studs on the adapter plates so that the pumps may be easily located in position while nuts are fitted to the threaded studs.

The present invention avoids the need to machine the forward facing surface of a lateral flange by mounting an adapter plate on its rear side so that the ancillary unit mates with the adapter plate rather than with the flange. This allows the face to which the ancillary unit mates to be machined without hindrance from any part of the block. The adapter plate needs itself to be mounted on a machined surface on the flange but as this surface is rearward facing, it can readily be machined at the same time as other parts of the end surface of the engine block that mate with the gearbox.

A further advantage of using an adapter plate to mount an ancillary unit on an engine is that the same engine block can be used with ancillary units of different design by changing only the adapter plate. Hence, by using an alternative adapter plate, it is possible to move the centre of the drive of the ancillary unit radially with respect to the crankshaft axis.

A further advantage of the invention resides in the fact that the adapter plate may be formed with an extension on its side remote from the engine lateral flange to accommodate an oil fed bushing or an anti-friction bearing to support the projecting end of the ancillary unit drive shaft. Such improved support for the ancillary unit drive shaft prolongs the life of the internal bearings of the ancillary unit.

By forming the adapter plate with an extension, it possible to ensure that the cog coupled to the drive shaft of the ancillary unit will remain captive between the adapter plate and adjacent abutment surfaces even after withdrawal of the ancillary unit drive shaft. This enables the ancillary unit to be removed for servicing without disturbing the meshing of the cog with the crankshaft driven gears and therefore without interfering with the engine timing.

Because the adapter plate is a machined component, it is possible to arrange for it to be formed with projecting bolts or studs onto which the ancillary unit can be mounted, thereby simplifying the alignment of the ancillary unit on the engine block during assembly.

Having thus described the invention, what is claimed as novel and desired to be secured by Letters Patent of the United States is:

1. An internal combustion engine block having first and second end faces and a lateral flange integral with said block and positioned at said second end face and formed with an aperture for mounting of an ancillary unit having a driveshaft, generally between said first and second end faces, and an adapter plate mountable on the end face of the lateral flange facing away from the first end face of said block to overlie the aperture for the ancillary unit, the surface of the adapter plate facing the aperture being machined to mate, when in use, with the ancillary unit disposed on the other side of the flange and secured to the adapter plate through the aperture in the lateral flange.

2. An engine block as claimed in claim 1, wherein the adapter plate is formed with an extension to accommodate a bearing to support the projecting end of the ancillary unit drive shaft.

3. An engine block as claimed in claim 2, wherein the extension extends in a direction away from the flange through the aperture.

4. An engine block as claimed in claim 3, wherein the adapter plate is formed with an extension serving to ensure that a gear coupled to the drive shaft of the ancillary unit will remain captive between the adapter plate and adjacent abutment surfaces after withdrawal of the ancillary unit drive shaft.

5. An engine block as claimed in claim 4, wherein the adjacent abutment surfaces are formed on a gearbox housing.

6. An engine block as claimed in claim 5, wherein the adapter plate is formed with projecting studs onto which the ancillary unit can be mounted.

7. An engine block as claimed in claim 1, wherein the adapter plate is provided with a projecting dowel received in a hole drilled in the lateral flange of the engine, to locate the adapter plate accurately on the flange.

8. An engine block as claimed in claim 1, wherein the adapter plate is formed such that the drive shaft axis of the ancillary unit is offset from the center of the aperture.

9. An engine block as claimed in claim 1, wherein one adapter plate can be substituted by an alternative form of adapter plate; the adapter plates having drive shaft axes of the ancillary unit which are offset from one another.

* * * * *